United States Patent [19]

Marcus

[11] Patent Number: 4,756,109

[45] Date of Patent: Jul. 12, 1988

[54] NURSERY MOBILE

[75] Inventor: Kenneth N. Marcus, Tipp City, Ohio

[73] Assignee: Dolly, Inc., Tipp City, Ohio

[21] Appl. No.: 527,924

[22] Filed: Aug. 30, 1983

[51] Int. Cl.[4] ..... G09F 19/00

[52] U.S. Cl. ..... 40/613; 40/617; 40/455

[58] Field of Search ..... 40/613, 617, 158, 615, 40/455; 46/158

[56] References Cited

U.S. PATENT DOCUMENTS

| | | | |
|---|---|---|---|
| 483,727 | 10/1892 | Smith | 46/158 |
| 1,659,720 | 2/1928 | Cate | 46/158 |
| 2,924,036 | 2/1960 | Rossiter | 40/613 |
| 3,044,914 | 7/1962 | Bell | 156/219 |
| 3,060,628 | 10/1962 | Palmer | 46/59 |
| 3,301,257 | 10/1967 | Crowe | 128/298 |
| 3,361,610 | 1/1968 | Hannes | 156/219 |
| 3,629,035 | 12/1971 | Kuroda | 156/219 |
| 3,762,084 | 10/1973 | Jones | 40/613 |
| 3,927,482 | 12/1975 | Marcus | 40/455 |
| 3,942,283 | 3/1976 | Rushton | 46/158 |
| 4,207,696 | 6/1980 | Hyman | 40/473 |
| 4,295,235 | 10/1981 | Deitz | 5/473 |

OTHER PUBLICATIONS

Dolly Toy, 1982 Catalog.
Dolly Toy, 1983 Catalog.

*Primary Examiner*—Robert Peshock
*Assistant Examiner*—Wenceslao J. Contreras
*Attorney, Agent, or Firm*—Killworth, Gottman, Hagan & Schaeff

[57] ABSTRACT

A nursery mobile having soft, laminated characters. The mobile characters have two soft outer plies of, preferably, a synthetic felt, an inner ply of a non-woven batting which has been treated with a thermoplastic resinous binder to render it heat sealable, and are heat sealed about the periphery. The mobile characters are made by assembling sheets of the plies, heat sealing with a dielectric die, and cutting the mobile character from the sheet-sized assembly.

6 Claims, 2 Drawing Sheets

NURSERY MOBILE

BACKGROUND OF THE INVENTION

The present invention relates to mobiles, and, more particularly, it relates to soft, laminated mobile characters for use with nursery mobiles or as associated nursery items. It also relates to the method for making such mobile characters.

Mobiles are common nursery accessories, and there are a number of types of mobiles. There are switch-activated, motor driven ones (see, for example, Marcus U.S. Pat. No. 3,927,482 assigned to the sama assignee as the present invention), there are sound-activated, motor driven ones (see Hyman U.S. Pat. No. 4,207,696), there are ones driven by a wound helical spring (see U.S. Pat. No. 3,060,628), and there are mobiles which require hand or wind movement for any rotation to occur. The one thing that these mobiles have, by definition, in common is that they have suspended objects that move upon activation.

Nursery mobiles generally are crib-mounted and have as the suspended objects some type of character, such as inanimate characters, caricatures of animals or story book characters or the like. In the past those characters have usually been made of wood, ceramics, or molded plastic. All of these items are relatively hard and rigid and present some danger to an infant advanced enough to pull himself up in the crib while the mobile is rotating. While soft, cloth mobile characters have been used previously, it is believed that any such characters were of the hand-sewn variety. Sewn cloth characters require labor intensive manufacturing processes and do not represent an economical way to avoid the dangers of relatively hard mobile characters.

Accordingly, the need exists for a soft, safe mobile character and for a fast and efficient method for producing such mobile characters.

SUMMARY OF THE INVENTION

The present invention meets that need by providing a soft, laminated mobile character for use with nursery mobiles or as associated nursery items. Preferably, the laminated character has three plies—two outer plies which may be of a synthetic felt, a soft vinyl plastic, or one of each and an inner ply of a non-woven batting which is heat sealable to the outer plies. The inner ply may be a non-woven polyester fill material which has been treated with a thermoplastic resinous binder to render it heat sealable. Either or both of the outer plies may be decorated with an appropriate design, such as an animal, story book character, TV or movie character, etc.

When used with a nursery mobile, the characters are preferably suspended by a string or the like from the ends of multiple branches (2 or more) which are attached, either rotatably or fixedly, to a support arm. At the other end of the support arm is a means, such as a clamp, for mounting the support arm on the side of a crib, for instance, so that the mobile characters are suspended over the crib.

The mobile characters should be of a size (5 or 6 inches in height) which may conveniently be suspended from mobile in this manner. Clearly, larger or smaller characters may be used with larger or smaller mobiles. Likewise, it is possible to produce large mobile characters of a design related to the mobile theme or nursery motif (or other design) for attachment to the wall or ends of the crib, or for placement elsewhere in the nursery.

In that instance a single character or part thereof may be formed from an assembly of sheet-sized plies. However, when a standard-sized mobile character is being prepared, several such characters may be cut from the sheet-sized assembly of plies. Thus, at least one of the outer ply sheets is decorated with a series of character designs. Preferable for use as outer plies is an approximately one-sixteenth inch polyester felt compatible with an approximately one-inch thick polyester batting which is placed in the assembly as the inner ply. The batting is preferably one treated with a thermoplastic resinous binder to render it heat sealable.

After assembly, a heat sealing die (preferably a dielectric die) having the shape of a character design on the upper one of the outer ply sheets, or having a series of such shapes corresponding to the series decorated on the outer ply sheet, is brought down around the character design at a sufficient time, temperature and pressure to form a heat seal around the periphery of the character design. As a part of the same operation or as a separate step, the character is cut from the sheet-sized assembly of plies.

During the heat sealing operation, the approximately one-inch thick polyester batting is to approximately one-half inch or less in thickness. Because the compressed batting of the inner ply is restrained by the outer plies, it gives a resilience to the character so that if squeezed and released, it will spring back into its original shape. The combination of this feature with the use of soft outer plies gives the mobile character a unique, light-weight, airy softness which is particularly advantageous for nursery mobiles.

Accordingly, it is an object of the present invention to provide a nursery mobile having novel mobile characters, to provide for use of larger versions of the novel mobile characters as associated nursery items, and to provide a method for producing those characters.

These and other objects and advantages of the invention will be apparent from the following description, the accompanying drawings, and the appended claims.

DETAILED DESCRIPTION OF THE PREFERRED EMBODIMENTS

Figure 1:
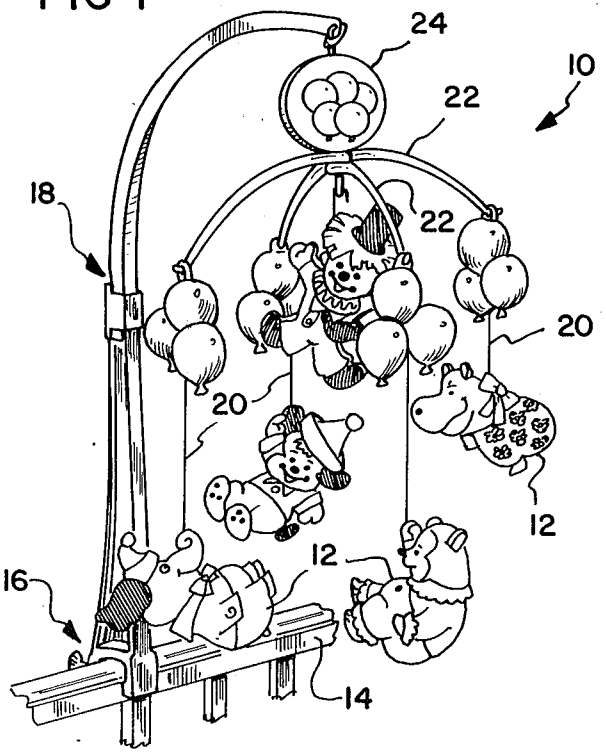
FIG. 1 is a perspective view of the nursery mobile of the present invention as seen in use attached to a crib.

Referring to FIG. 1, there is shown a nursery mobile 10 having the unique mobile characters 12 of the present invention. The nursery mobile shown is one which is attached to the side of crib 14 by means of clamp 16. Obviously, the mobile may be mounted on other objects. It may also be of the type which is attached to the wall, suspended from the ceiling, or otherwise displayed in the nursery or elsewhere.

In any event, the basic elements remain the same in that there is generally a support arm 18, as shown, and a means for suspending mobile characters 12 directly or indirectly from the support arm 18. In FIG. 1, mobile characters 12 are suspended by strings 20 from the ends of branches 22. Branches 22 are, then, -ttached to a mechanical (wound spring) means to rotate the branches, which in this instance is also a music box 24. Two branches 22 are shown, with one mobile character 12 suspended from each end thereof (four characters). More branches and mobile characters may be added, as desired.

Figure 2:
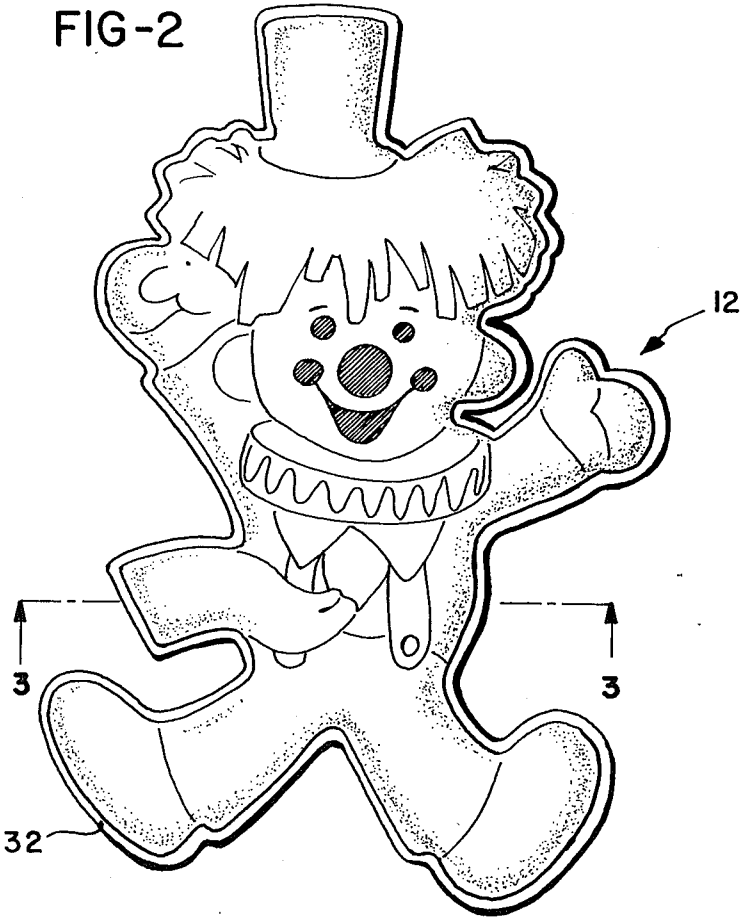
FIG. 2 is a top plan view of the novel mobile character of the present invention.

There is also shown in FIG. 1 a fifth, central, mobile character 12 which is suspended directly beneath music box 24. That central mobile character is shown in greater detail in FIG. 2. As shown a character design, in this case the front view of a balloon vendor clown, is decorated on the front surface. A rear view of a balloon vendor clown may be decorated on the backside of the mobile character, or the back may be plain or colored.

Figure 3:
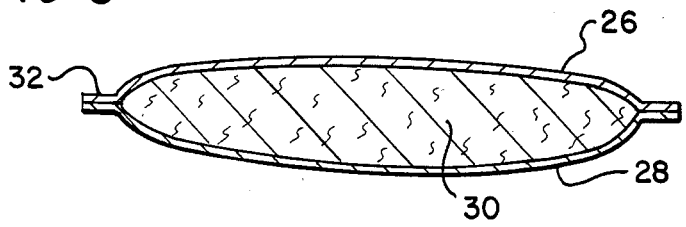
FIG. 3 is a cross-sectional view of the mobile character taken along line 3—3 of FIG. 2.

A cross-section of the mobile character 12 is shown in FIG. 3 where there are outer plies 26 and 28 and inner ply 30. For illustration purposes the upper surface of outer ply 26 will be considered the one decorated with the front view of the balloon vendor clown and outer ply 28 will be considered to be of a solid color. The outer plies 26 and 28 as shown are both one-sixteenth inch thick polyester felts which are easily decorated or dyed by standard techniques. Plain sheets or rolls of such felt, sold as style C-2 felt, may be purchased from Commonwealth Felt Co., Boston, Mass. Other types of synthetic felts or soft vinyl plastics may also be used so long as those materials are compatible with that used for inner ply 30.

Inner ply 30 is preferrably a non-woven polyester fill material which has dispersed throughout small beads of a thermoplastic vinyl resin binder in order to render it heat sealable. Sheets of such material are available as 7 oz. unbranded polyester from Union Wadding Co., of Pawtucket, R.I. In its unlaminated state (see FIG. 4), the inner ply 30 is preferably approximately one-inch thick. It is compressed during the laminating operation so that it is less than one-half that thickness in the laminated mobile character (see FIG. 3). A heat seal around the periphery 32 (see FIGS. 2 and 3) bonds the assembled plies 26, 28 and 30 together.

Figure 4:
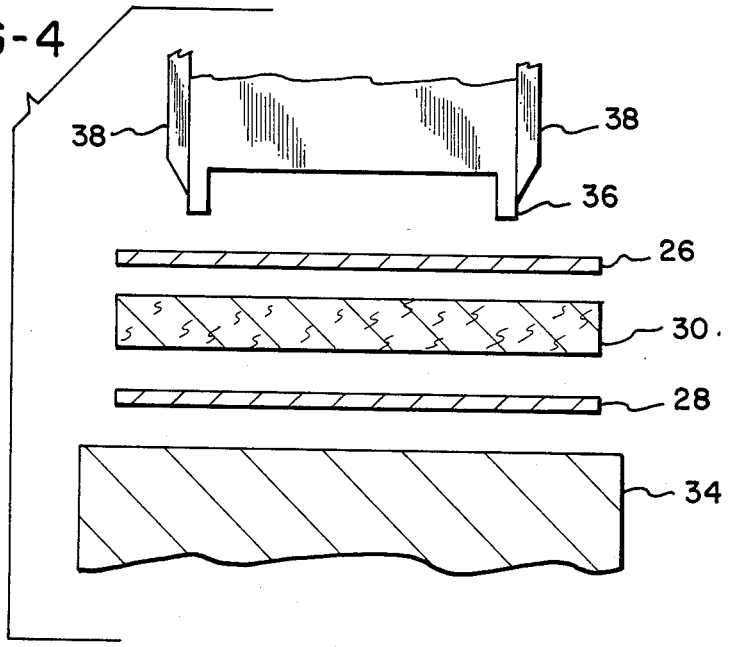
FIG. 4 is an exploded, schematic view illustrating the laminating operation used to produce the mobile characters of the present invention.

The laminating operation is shown schematically in FIG. 4 where a sheet of inner ply 30 is assembled between sheets of outer plies 26 and 28. The assembled plies are placed on a platen 34, which may be heated to the desired temperature (around 350° F). In this instance outer ply 26 is shown as the upper one, but obviously, outer ply 28 could just as easily be placed uppermost. In any event in the arrangement shown, dielectric die 36 is brought down around the character design decorated on the upper surface of outer ply 26 for a sufficient time to form a heat seal around the periphery 32. The dielectric heat generated should be sufficient to raise the temperature of the thermoplastic binder in the non-woven batting of inner ply 30 to above its melting point. At the same time, the heat from platen 34 and the pressure from the dielectric die 36 compresses inner layer 30 to the thickness previously described.

As shown in FIG. 4, dielectric die 36 has associated with it a cutter blade 38 which, following the heat sealing step, cuts around the periphery 32 of the mobile character to remove the mobile character from the sheet-sized assembled plies. A separate cutting operation may be used instead if desired.

When relatively small mobile characters for a nursery mobile are being produced, a series of character designs will be present on the upper surface of a sheet sized outer ply 26 and a number of mobile characters 12 will be cut out of the sheet-sized assembly of plies. It is also possible to heat seal and cut a single, large mobile character (or even parts of an even larger character) out of the sheet-sized assembly of plies.

Thus, large characters of the same design or of a related design for use in the chosen nursery motif, may be fastened to the ends of the crib or the wall. When outer plies 26 and 28 are of felt, Velcro tape fasteners may be used for that purpose or other attachment means may be used. In this manner it is possible to coordinate the mobile theme with other nursery accessories to achieve an overall nursery motif.

All of the characters for use with the mobile and associated nursery items may be the soft, laminated ones of the present invention. The mobile characters are safe, decorative, and easy to manufacture. The result is a mobile, and associated nursery items, which have a number of advantages over those previously used.

What is claimed is:

1. In a mobile, suitable for crib-mouting, having a mounting means, a support arm attached thereto, and means for suspending objects directly or indirectly from said support arm, the improvement comprising: soft, resilient, compressible, laminated characters suspended from said means for suspending objects, each said laminated character having two soft outer plies and an inner ply of a partially compressed non-woven batting which is heat sealable to said outer plies, and having a heat sealed periphery, each of said laminated characters also being light weight and non-free standing whereby the suspended laminated characters will not present a striking danger to the occupant of the crib to which said mobile is mounted.

2. The mobile of claim 1 wherein said outer plies are selected from the group consisting of a synthetic felt, a soft vinyl plastic, and combinations thereof.

3. The mobile of claim 2 wherein said inner ply is a non-woven polyester fill material which has been treated with a thermoplastic resinous binder to render it heat sealable.

4. The mobile of claim 1 where at least four of said laminated characters are suspended by strings, each from and end of at least two branches which are connected to said support arm.

5. The mobile of claim 3 wherein said inner ply is compressed to less than approximately one-half inch in thickness.

6. The mobile of claim 5 wherein said outer plies are approximately one-sixteenth inch thick polyester felts.

* * * * *